US006439645B1

(12) United States Patent
Pedersen

(10) Patent No.: US 6,439,645 B1
(45) Date of Patent: Aug. 27, 2002

(54) MOBILE ALL-TERRAIN VEHICLE ENCLOSURE

(75) Inventor: Scott Pedersen, Howard, SD (US)

(73) Assignee: U.S.L. Products, Inc., Minneapolis, MN (US)

( * ) Notice: Subject to any disclaimer, the term of this patent is extended or adjusted under 35 U.S.C. 154(b) by 0 days.

(21) Appl. No.: 09/895,726

(22) Filed: Jun. 29, 2001

(51) Int. Cl.[7] ..... E04H 15/06

(52) U.S. Cl. ..... 296/161; 296/136; 296/77.1; 135/88.05; 135/88.13

(58) Field of Search ..... 296/136, 161, 296/102, 77.1; 135/88.01, 88.05, 88.13

(56) References Cited

U.S. PATENT DOCUMENTS

| | | | | | |
|---|---|---|---|---|---|
| 1,142,329 | A | * | 6/1915 | Jones | 296/136 |
| 1,173,618 | A | * | 2/1916 | Taber | 296/136 |
| 1,190,890 | A | * | 7/1916 | Hanauer | 296/136 |
| 2,571,362 | A | * | 10/1951 | Hervey | 296/136 |
| 2,826,210 | A | * | 3/1958 | Heil | 135/88.13 |
| 3,785,697 | A | | 1/1974 | Dabbs | 296/136 |
| 3,884,523 | A | | 5/1975 | Allen | 296/136 |
| 3,913,968 | A | | 10/1975 | Luppens | 296/23 |
| 4,091,484 | A | * | 5/1978 | Means | 296/136 |
| 4,114,633 | A | | 9/1978 | Herbez | 135/1 A |
| 4,402,544 | A | * | 9/1983 | Artim et al. | 135/88.05 |
| 4,425,929 | A | | 1/1984 | Von Mosshaim | 135/102 |
| 4,800,986 | A | * | 1/1989 | Hayes, III | 182/18 |
| 4,950,017 | A | * | 8/1990 | Norton | 296/77.1 |
| 4,973,082 | A | * | 11/1990 | Kincheloe | 296/79.1 |
| 5,174,622 | A | * | 12/1992 | Gutta | 296/77.1 |
| 5,203,601 | A | * | 4/1993 | Guillot | 296/77.1 |
| 5,297,844 | A | * | 3/1994 | Haustein | 296/190 |
| 5,313,972 | A | * | 5/1994 | Goldberg | 135/88 |
| 5,720,312 | A | | 2/1998 | Scheuermann | 135/88.09 |
| 5,897,156 | A | * | 4/1999 | Hayard et al. | 296/136 |
| 6,017,081 | A | * | 1/2000 | Colby | 296/173 |
| 6,092,856 | A | * | 7/2000 | Ladensack | 296/136 |
| 6,105,721 | A | | 8/2000 | Haynes | 182/127 |
| 6,206,446 | B1 | * | 3/2001 | Slayden | 296/77.1 |
| 6,349,732 | B1 | * | 2/2002 | Cooper | 135/133 |

OTHER PUBLICATIONS

USL Outdoor Products Incorporated Quad Shak pictures, www.quadshak.com, 2001–2002.*

USL Outdoor Products Incorporated Remington Tree Stands Brochure Dave Genz™ FISH TRAP(pp. 8 and 9).

ATV Connection Magazine (www.atvconnection.com), Ray Dedorchuk, BUG CAB, Jan. 12, 2000, pp. 1–3.

ATV Magazine, Glenn Hansen, COMFORT CAP CABS, Mar./Apr. 2001, p. 67.

1 pg. flyer, Scott Pedersen, PEDERSEN'S PORTABLE HUNTING BLIND/ICE HOUSE, first disclosed Oct., 1998.

* cited by examiner

*Primary Examiner*—Joseph D. Pape
*Assistant Examiner*—Hilary Gutman
(74) *Attorney, Agent, or Firm*—Kinney & Lange, P.A.

(57) ABSTRACT

An enclosure is disclosed for mounting to an all-terrain vehicle (ATV). The enclosure includes a first canopy bracket mountable to a front rack of the ATV and a second canopy bracket mountable to a rear rack of the ATV. A frame comprising a plurality of support members is pivotally attached to the first canopy bracket and the second canopy bracket. The plurality of support members pivot around the canopy brackets between a collapsed position and an open position. A cover is positioned over the frame such that when the frame is in the collapsed position the cover is folded and when the frame is in the open position the cover is open.

17 Claims, 10 Drawing Sheets

MOBILE ALL-TERRAIN VEHICLE ENCLOSURE

CROSS-REFERENCE TO RELATED APPLICATION(S)

None.

BACKGROUND OF THE INVENTION

The present invention relates to an enclosure for an all-terrain vehicle (ATV). In particular, the present invention relates to an enclosure that is mounted to the ATV in a folded manner that allows normal use of the ATV and yet is quickly and easily deployable over the entire ATV.

ATVs are typically used by people as a mode of transportation or a recreational vehicle. ATVs are often used by individuals during hunting, ice fishing, and other outdoor activities. The smaller size and compactness of an ATV allows users, including hunters and campers to reach secluded areas not normally accessible by cars and trucks. Additionally, the design of ATVs allow users to maneuver rugged terrain not easily reached by other vehicles or hiking and more easily and quickly reached by an ATV. The ATV also aids the user by carrying equipment and allowing the user to ride to the desired location. ATVs are also useful for ice fishing to carry individuals and their equipment to the designated fishing spot. ATVs are lighter than other vehicles, such as cars and trucks, used to reach fishing spots thereby having a lower risk of falling through the ice.

Hunting and ice fishing typically occur during the fall and winter months when inclement weather and harsh weather conditions exist. Users and the ATV will often need to be protected from the weather. Campers will also need an area to setup camp, a place to eat, and rest. The compact size of the ATV limits the amount of equipment, including shelter, an individual can carry. Furthermore, because of the transitory nature of hunting and ice fishing any shelter an individual uses should allow for quick and easy setup and take down.

It is desirable to have a shelter for mounting to an ATV that is portable, easy to setup and take down by its user, and provides an area for the user to hunt, fish, rest or camp.

BRIEF SUMMARY OF THE INVENTION

The present invention relates to an enclosure for mounting to an all-terrain vehicle (ATV). The enclosure has a first canopy bracket mountable to a front rack of the ATV and a second canopy bracket mountable to a rear rack of an ATV. A frame comprising a plurality of support members is pivotally attached to the first and second canopy brackets. Wherein the plurality of support members pivot around the canopy brackets between a collapsed position and an open position. A cover is positioned over the frame such that when the frame is in the collapsed position the cover is folded and when the frame is in the deployed position the cover is open.

DETAILED DESCRIPTION

Figure 1:
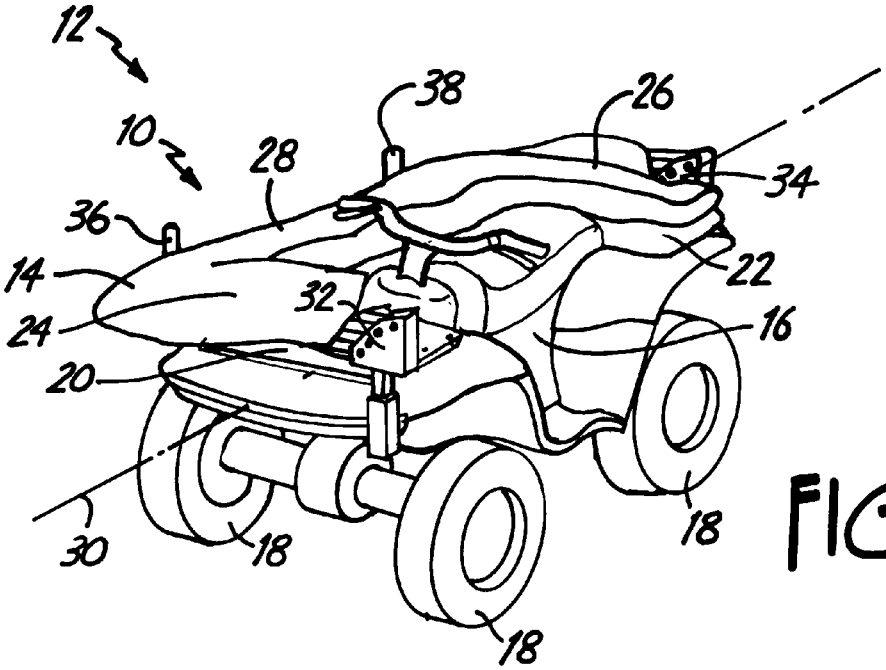
FIG. 1 is a perspective view of the present invention mounted to an ATV in a collapsed position.

The present invention is a portable enclosure for mounting to an all-terrain vehicle (ATV). FIG. 1 shows an enclosure 10 in a collapsed position mounted to an ATV 12. In the collapsed position, the enclosure 10 is covered by a removable sleeve 14. The removable sleeve 14 protects the enclosure 10 while the ATV 12 is driven by an operator or towed on a trailer. The ATV 12 has a body 16, wheels 18, a front rack 20 and a rear rack 22. The ATV 12 serves as a base for the enclosure 10.

In the collapsed position, the enclosure 10 has a C-shape and rests in part on the front rack 20 and the rear rack 22 of the ATV 12. The enclosure has a front end 24, a rear end 26 and a support section 28. The front end 24 lies on the front rack 20 and the rear end 26 lies on the rear rack 22. The support section 28 extends between the front and rear ends 24 and 26 and lies substantially parallel to a longitudinal axis 30 of the ATV 12. In the collapsed position, the support section 28 of enclosure 10 is located to one side of the ATV 12 so as not to impede an ATV driver from operating the ATV 12. An ATV driver is still able to operate the ATV 12 with the enclosure 10 mounted to the ATV.

A pair of brackets are mounted to the ATV 12 for attaching the enclosure 10 to the ATV. A first canopy bracket 32 is mounted to the front rack 20 of the ATV 12. A second canopy bracket 34 is mounted to the rear rack 22 of the ATV 12. The front end 24 of the enclosure 10 is pivotally attached to the first canopy bracket 32. The rear end 26 of the enclosure 10 is pivotally attached to the second canopy bracket 34. The enclosure 10 pivots around the canopy brackets 32 and 34 between the collapsed position and an open position (or deployed position). A front arm 36 and a rear arm 38 are attached to the front and rear racks 20 and 22, respectively. The arms 36 and 38 help to support the enclosure 10 when it is in the collapsed position.

Figure 2:
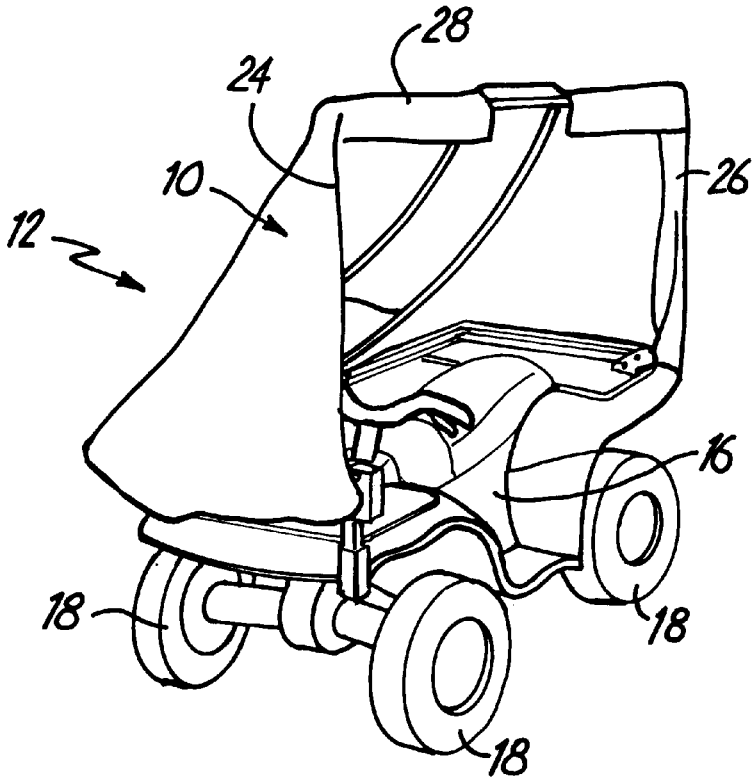
FIG. 2 is a perspective view of the present invention in a partially deployed position.
Figure 3:
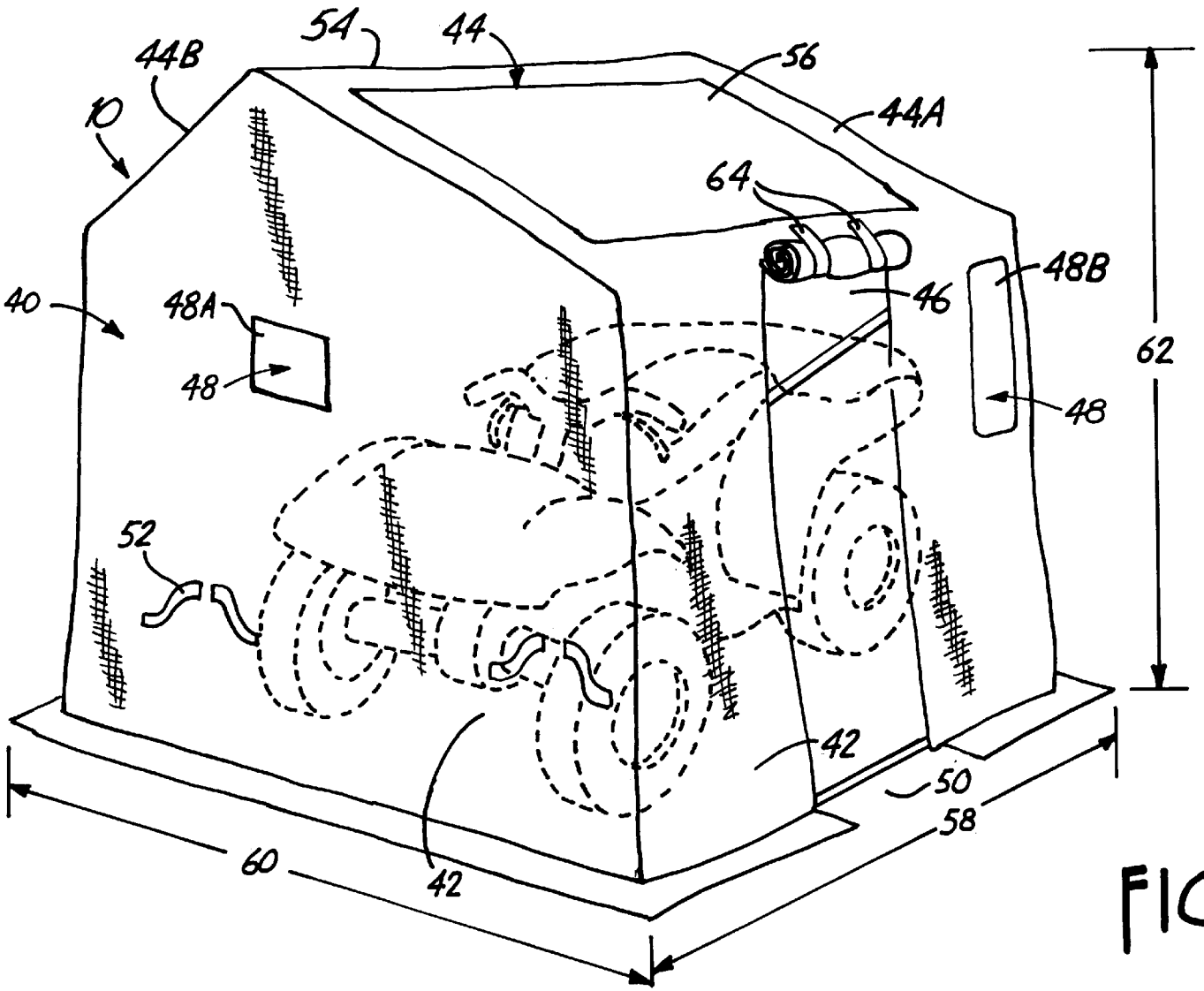
FIG. 3 is a perspective view of the present invention in a fully deployed position enclosing the ATV.

FIG. 2 shows the enclosure 10 as it is partially open and between the collapsed position (FIG. 1) and the open position. FIG. 3 shows the enclosure 10 in the open position. In the open position, the enclosure 10 completely encloses the ATV 12. The enclosure is comprised of a cover 40 supported by a frame that gives the enclosure 10 its shape and supports the cover 40. In one embodiment, the cover 40 has side walls 42, a roof 44, a door 46, and at least one window 48. The walls 42 extend to a surface 50, generally the ground or ice, on which the ATV 12 sits. The cover 40 is typically wind proof and waterproof. A plurality of tie-down ribbons 52 are attached to the cover 40. The tie-down ribbons 52 allow a user to secure brush or foliage to the cover 40 such that the enclosure 10 blends in with its surrounding environment.

The roof 44 has a peak 54 dividing the roof 44 into two sections (44A and 44B). A portion of both sections 44A and 44B of the roof 44 may be removed to create an opening 56 in the roof 44. Preferably, the opening 56 on the roof 44, the door 46, and the windows 48 use zippers to open and close. The opening 56 allows a user using the enclosure 10 as a hunting blind to hunt from within the enclosure 10.

In the open position, the enclosure 10 completely encloses the ATV 12. In one exemplary embodiment, the enclosure has a length 58 of approximately 92 inches, a width 60 of approximately 82 inches, and a height 62 of approximately 82 inches. When opened, the width 60 of the enclosure 10 is greater than a width of the ATV 12. The enclosure 10 is large enough for a user to stand up, lie down and/or camp within. A user using the enclosure 10 for ice fishing has room to sit and fish within the enclosure 10. Although the door 46 shown in FIG. 3 is shown having a rectangular shape, the door may take other shapes such as a U-shape. The door 46 allows the user to enter and exit the enclosure. VELCRO ties 64, hook and loop fasteners, or other suitable means, secure the door 46 in an open position. The windows 48 have one of two shapes (both are shown in FIG. 3). One shape for the window 48 is a substantially square shape (shown by the window 48A). Alternatively, window 48 may be formed as an elongated rectangle (shown by the window 48B). The window 48B allows hunters to hunt from within the enclosure 10. Any number of windows may be included with the enclosure 10. Windows may be covered with clear material or may be formed as flaps of material used to form cover 40.

Figure 4:
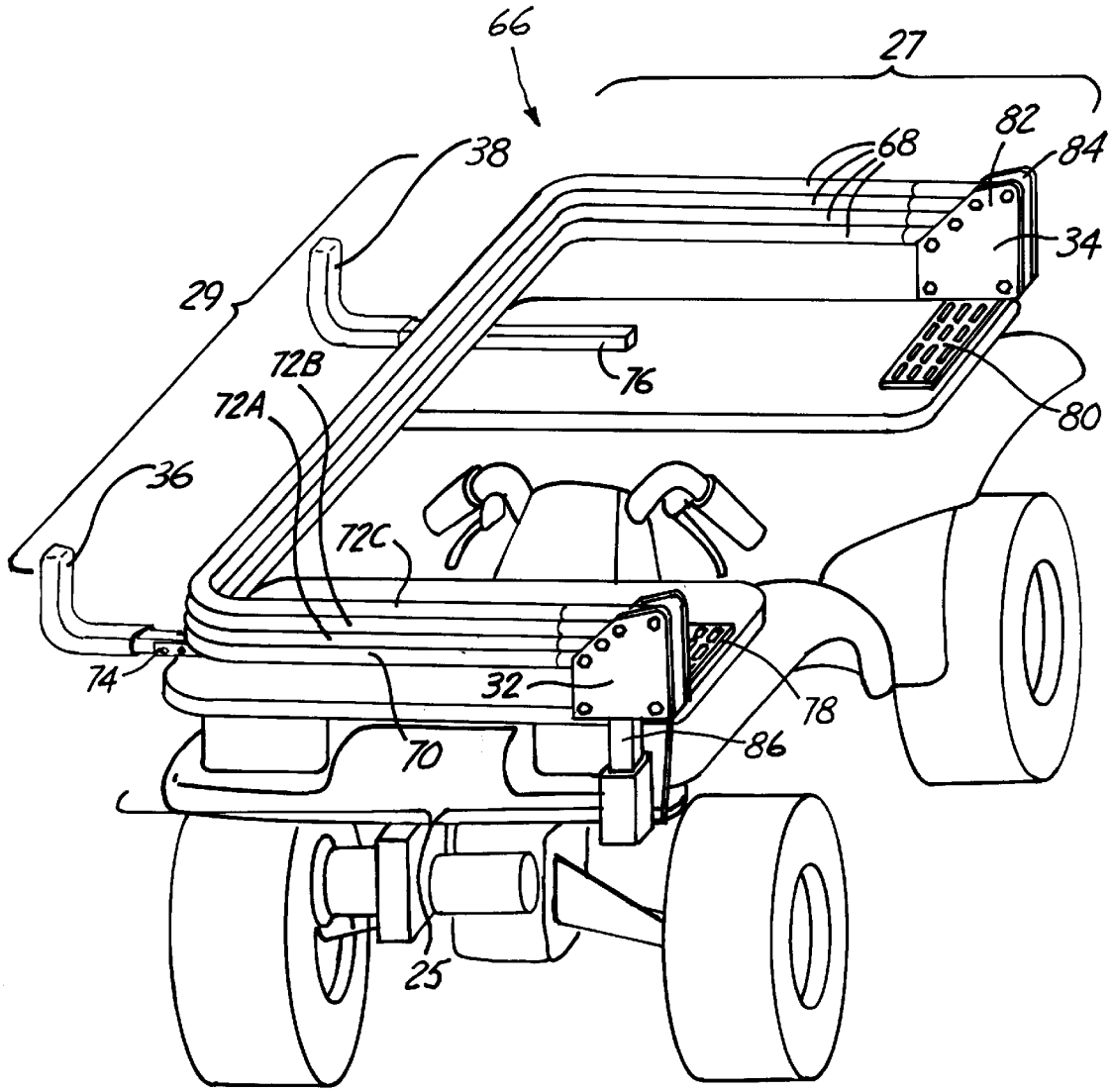
FIG. 4 is a perspective view of a frame of the present invention in the collapsed position mounted to the ATV.

FIG. 4 is a perspective view of the enclosure 10 in the collapsed position mounted to the ATV 12. In FIG. 4, the cover 40 is removed to reveal a frame 66 for mounting to the ATV 12. In the embodiment shown, the frame 66 is comprised of four canopy members 68, or support members. The canopy members 68 are support members that provide support for the enclosure 10 in the open position. Each canopy member 68 is preferably U-shaped and has opposing arms, that is a first section 25 and a second section 27 lying substantially parallel to the first section 25. A connecting member 29, or linking section, connects the first section 25 to the second section 27. The connecting member 29 is approximately as long as the distance between the first and second canopy brackets 32 and 34.

The assembly of the canopy members 68 will be discussed in further detail with relation to FIGS. 9 and 10.

The first section 25 of the canopy members 68 is pivotally attached to the first canopy bracket 32 and the second section 27 of the canopy members 68 is pivotally attached to the second canopy bracket 34. The canopy members 68 include an inner canopy member 70 and three outer canopy members 72A, 72B and 72C. Those skilled in the art will recognize any number of outer canopy members may be used, although three are shown in FIG. 4. In the collapsed position, the canopy members 68 rest on the front and rear racks 20 and 22 of the ATV 12. The outer canopy members 72A, 72B, and 72C lie on top of the inner canopy member 70 in the collapsed position.

Figure 5:
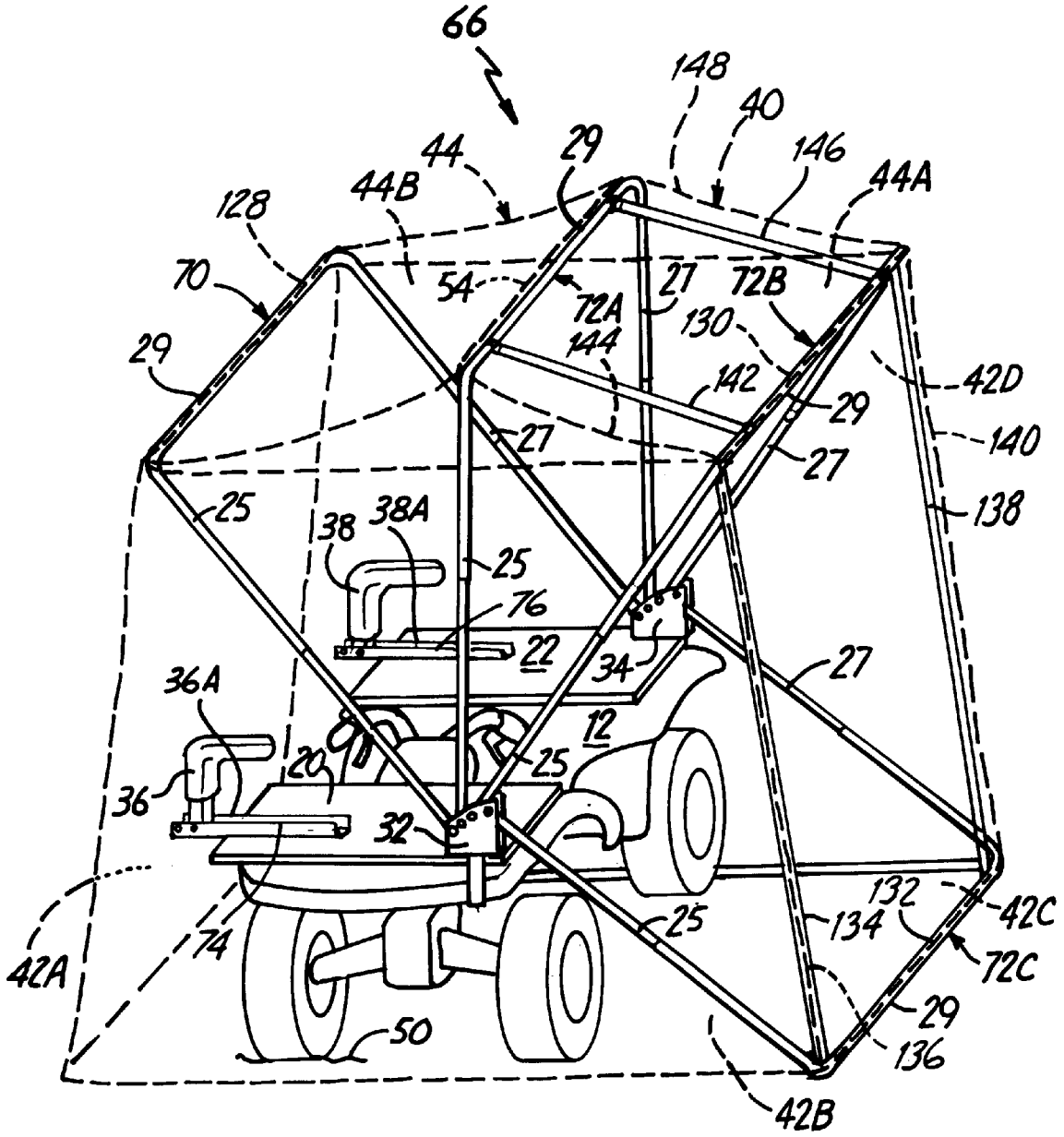
FIG. 5 is a perspective view of the frame of the present invention in the fully deployed position mounted to the ATV.

A front arm bracket 74 is mounted to the front rack 20 of the ATV 12 and a rear arm bracket 76 is mounted to the rear rack 22, preferably by bolts or other suitable means. The front arm 36 is pivotally attached to the front arm bracket 74 and the rear arm 38 is pivotally attached to the rear arm bracket 76. The arms 36 and 38 are preferably L-shaped. The arms 36 and 38 are movable between a first position (as seen in FIG. 4) and a second position (as seen in FIG. 5). The arms 36 and 38 are placed in the first position to help support the frame 66 when it is in the collapsed position. When the frame 66 is pivoted to the open position, the arms 36 and 38 are moved to the second position and out of the way of the enclosure 10.

Mounting sections are preferably used to reversibly connect the canopy brackets, that is the support member holding section, to the ATV 12. A front mounting bracket 78 is mounted to the front rack 20 of the ATV 12 and a rear mounting bracket 80 is mounted to the rear rack 22. The first canopy bracket 32 is attached to the front mounting bracket 78 and the second canopy bracket 34 is attached to the rear mounting bracket 80. The canopy brackets 32 and 34 are comprised of a first section 82 and a second section 84, which are identical. Canopy brackets 32 and 34 each have a height adjusting member 86 extending from the bottom of the canopy bracket. The height adjusting member 86 permits the adjustment to the height of the canopy brackets 32 and 34 with respect to the mounting brackets 78 and 80, respectively.

Figure 4A:
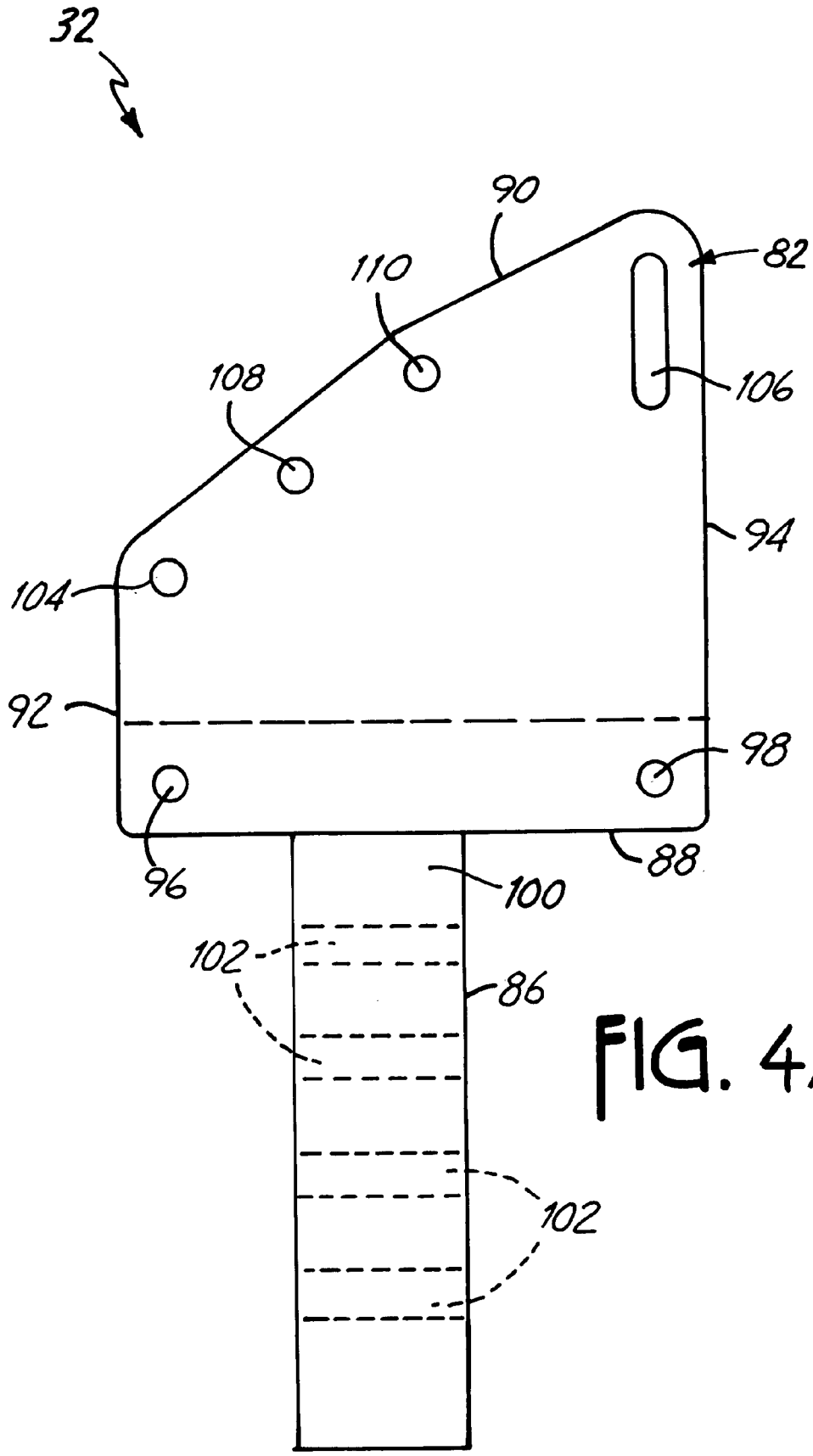
FIG. 4A is a side view of a canopy bracket of the present invention.

FIG. 4A is a side view of the first canopy bracket 32. In particular, the first section 82 of the first canopy bracket 32 is shown. The second canopy bracket 34 is identical to the first canopy bracket 32. The canopy bracket 32 has a bottom edge 88, a sloped top edge 90, a first side edge 92, and a second side edge 94. The first side edge 92 and the second side edge 94 are substantially parallel to each other, although the second side edge 94 is longer than the first side edge 92 so that the top edge 90 is sloped therebetween.

There are two mounting brackets holes for securing the height adjusting member 86 to the canopy bracket 32. A first mounting bracket hole 96 and a second mounting bracket hole 98 are provided through bracket 32 along the bottom edge 88. The first mounting bracket hole 96 lies along the first side edge 92. The second mounting bracket hole 98 lies along the second side edge 94.

The height adjusting member 86 is preferably T-shaped. A T-support 100 of the height adjusting member 86 is mounted to the canopy bracket 32 and preferably secured by a fastener, such as a bolt, to mounting bracket holes 96 and 98. The T-support 100 of the height adjusting member 86 is shown in phantom in FIG. 4A and preferably lies between the first and second sections 82 and 84 of the canopy bracket 32. The height adjusting member 86 extends beyond the bottom edge 88 of the canopy bracket 32. Bores 102 (shown in phantom) are provided in the height adjusting member 86. The bores 102 are used to secure the canopy bracket 32 to the mounting bracket 78 attached to the ATV 12.

Four canopy member mounting holes are disposed through the canopy bracket 32 along the top edge 90 for securing the canopy members 68 to the canopy bracket 32. A first canopy member mounting hole 104 is adjacent to an intersection between the top edge 90 and the first side edge 92. An elongated fourth canopy member mounting hole 106 is adjacent to an intersection between the top edge 90 and the second side edge 94. The fourth canopy member mounting hole 106 extends towards the bottom edge 88 of the canopy bracket 32 and is oval shaped. A second canopy member mounting hole 108 and a third canopy member mounting hole 110 lie along the top edge 90 between the first canopy member mounting hole 104 and the fourth canopy member mounting hole 106. Preferably, the third canopy member mounting hole 110 is about equidistant between the first side edge 92 and the second side edge 94. The second canopy member mounting hole 108 is preferably spaced half-way between the first canopy member mounting hole 104 and the third canopy member mounting hole 110.

Figure 4B:
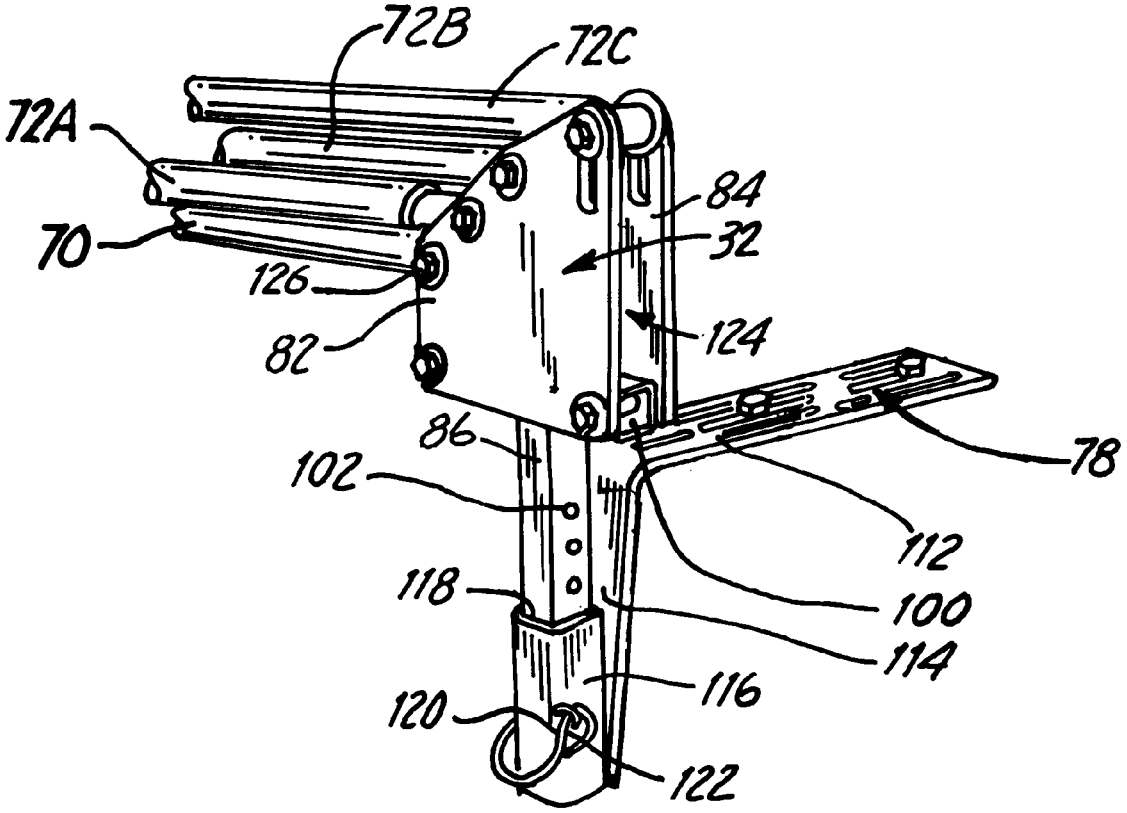
FIG. 4B is a perspective view of the canopy bracket and a mounting bracket of the present invention.

FIG. 4B illustrates a perspective view of the first canopy bracket 32 and the front mounting bracket 78. The configuration for the second canopy bracket 34 and mounting bracket 80 will be identical. The mounting bracket 78 has a base 112, an extension 114, and a receiver 116. The base 112 attaches to the front rack 20 of the ATV 12. The base 112 is aligned with a front edge of the front rack 20 and the extension 114 extends downward and substantially perpendicular from the base 112. The receiver 116 extends substantially parallel to the extension 114. The receiver 116 has a cavity 118 adapted for receiving the height adjusting member 86 of the canopy bracket 32.

The height adjusting member 86 is inserted into the cavity 118 of the receiver 116. Receiver 116 has at least one hole 120 formed in one of its walls for alignment with the bores 102 on the height adjusting member 86. When the height adjusting member 86 is inserted into the receiver 116, one bore 102 of the height adjusting member 86 is aligned with the holes 120 of the receiver. A pin 122 is inserted through the bore 102 and the holes 120 to hold the canopy bracket 32 in place. The height of the canopy bracket 32 is adjusted with respect to the mounting bracket 78 by moving the height adjusting member upward or downward and aligning a different bore 102 with the holes 120 of the support 116.

The canopy bracket 32 is comprised of the first section 82 and the second section 84. The T-support 100 of the height adjusting member 86 is mounted to the canopy bracket 32 and preferably secured by bolts to mounting bracket holes 96 and 98. The T-support 100 of the height adjusting member 86 forms a bottom wall of canopy bracket 32. The T-support 100 further aids in defining a channel 124, or spacing, between the first and second sections 82 and 84 thereby allowing connection of canopy members 68 to the canopy bracket 32 within the channel 124.

The canopy members 68 are mounted to the canopy member mounting holes 104, 108, 110, and 106 within the channel 124 of the canopy bracket 32. Both the first and second sections 82 and 84 include canopy member mounting holes 104, 108, 110, and 106. In one embodiment, the inner canopy member 70 is mounted to the first canopy member mounting hole 104, the first outer canopy member 72A is mounted to the second canopy member mounting hole 108, the second outer canopy member 72B is mounted to the third canopy member mounting hole 110, and the third outer canopy member 72C is mounted to the fourth canopy member mounting hole 106. A hole (not shown) is located at the end of the first section 25 of each canopy member 68. The hole is aligned with the canopy member mounting holes located on the canopy bracket 32 and a fastener 126, such as a bolt, is disposed through the holes to connect the canopy member 68 to the canopy bracket 32. The same features are used to connect the second section 27 of the canopy members 68 to the canopy bracket 34.

As seen in FIG. 4, the enclosure 10 is preferably assembled once and mounted to the ATV 12. When the enclosure is mounted to the ATV 12 and in the collapsed position, the user is able to operate the ATV 12. However, the enclosure 10 once assembled may be removed from the ATV 12 to permit use of the enclosure 10. To remove the enclosure 10, the pin 122 holding the canopy brackets 32 and 34 in place is removed from bore 102 and holes 120. The height adjusting member 86 of the canopy brackets is lifted out of the receiver 116 of the mounting brackets to remove the entire enclosure 10 from the ATV 12.

To open the enclosure 10, the user pulls upward on the third outer canopy member 72C. By lifting the third outer canopy member 72C, the cover 40 (not shown) pulls on the other canopy members 68 and thereby opens the enclosure 10 (as seen in FIG. 2). The canopy members 68 pivot around the canopy brackets 32 and 34. Preferably the canopy members 68 are positioned parallel to the longitudinal axis 30 of the ATV. Thus, when the enclosure 10 is moved from the collapsed position to the open position the enclosure 10 opens across the body 16 of the ATV 12.

FIG. 5 is a perspective view of the enclosure 10 in the open position mounted to the ATV 12. In FIG. 5, the cover 40 is shown in phantom to reveal the frame 66. In the open position, the canopy members 68 define the shape of the enclosure 10. The inner canopy member 70 is positioned along an intersection 128 of the wall 42A and the roof44. The first canopy member 72A is positioned along the peak 54 of the roof 44. The second outer canopy member 72B is positioned along an intersection 130 between the wall 42C and the roof 44. The third outer canopy member 72C is positioned along a base 132 of wall 42C where the wall 42C contacts the surface 50. A break line is shown on the outer canopy members 72A, 72B and 72C to represent telescoping sections of those members. The telescoping action of the outer canopy members allows the members to shorten for storage and lengthen to expand the volume and shape of the enclosure.

In the open position the user manually adds support (or spreader) poles to the enclosure 10 for additional support. A front side spreader pole 134 is positioned along an intersection 136 between the wall 42B and the wall 42C. One end of the front side spreader pole 134 is mounted to the third outer canopy member 72C proximate where the connecting member 29 connects to the first section 25. The other end of the front side spreader pole 134 is mounted to the second outer canopy member 72B proximate where the connecting member 29 connects to the first section 25. A rear side spreader pole 138 is positioned along an intersection 140 between the wall 42C and the wall 42D. One end of the rear side spreader pole 138 is mounted to the third outer canopy member 72C proximate where the connecting member 24 connects to the second section 27. The other end is mounted to the second outer canopy member 72B proximate where the connecting member 29 connects to the second section 27.

A front roof spreader pole 142 is positioned along an intersection 144 of the wall 42B and the roof section 44A. One end of the front roof spreader pole 142 is mounted to the second outer canopy member 72B proximate to where the connecting member 29 connects to the first section 25. The other end is mounted to the first outer canopy member 72A proximate where the connecting member 29 connects to the first section 25. A rear roof spreader pole 146 is positioned along an intersection 148 of the wall 42D and the roof section 44A. One end of the rear roof spreader pole 146 is mounted to the second outer canopy member 72B proximate where the connecting member 29 connects to the second section 27. The other end is mounted to the first outer canopy member 72A proximate where the connecting member 29 connects to the second section 27. Those skilled in the art will recognize that tabs may be attached to the cover 40 and rope may be run through the tabs and secured to the surface 50 to provide additional support to the enclosure.

Each end of the spreader poles 134, 138, 142, and 146 has a C-shape clamp to mount the spreader poles to their respective outer canopy members 72A, 72B, and 72C. The clamps make a reversible mechanical connection to the outer canopy members, thereby providing additional support for the enclosure 10.

The first arm 36 and the second arm 38 are manually pivoted into the second position when the enclosure 10 is in the open position. After the enclosure 10 is moved into the open position, the user pivots the arms 36 and 38 upward and about 90 degrees. The arms 36 and 38 are moved out of the way of the wall 42A and rest inside the enclosure 10. The user then pulls the wall 42A downward so that the wall 42A extends to the surface 50.

To move the enclosure 10 from the open position to the collapsed position the user must first remove the spreader poles 134, 138, 142, and 146. Next, the user lifts the third outer canopy member 72C upward such that the third outer canopy member 72C pivots around the canopy brackets 32 and 34 into the collapsed position (as seen in FIG. 4). The force acting on the third outer canopy member 72C pushes the other canopy members 68 back into the collapsed position.

Figure 6:
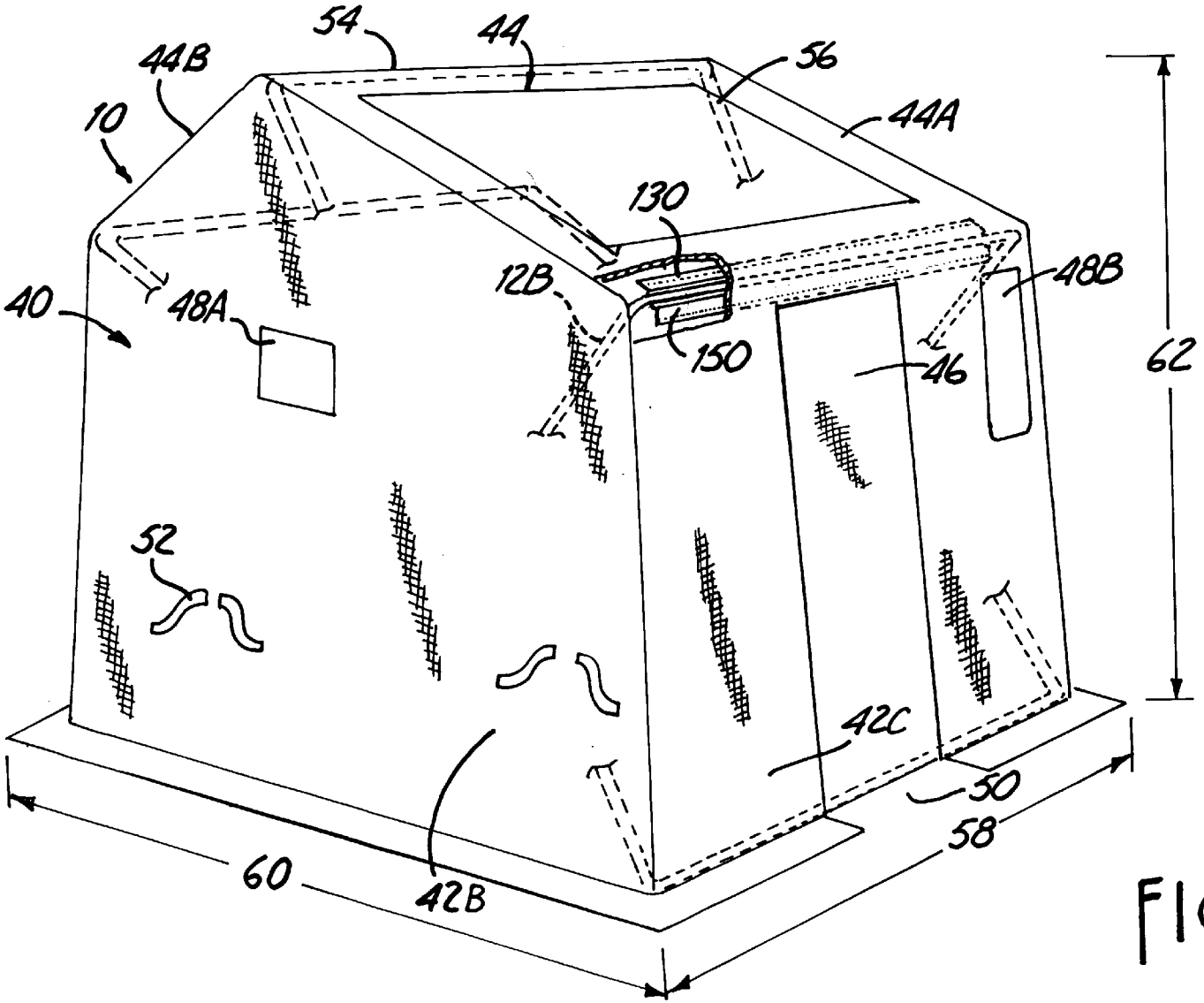
FIG. 6 is a cutaway view of the enclosure taken from FIG. 3.

FIG. 6 is a cutaway view of the enclosure 10 taken from FIG. 3 to reveal the second outer canopy member 72B housed within a sleeve 150. Preferably the canopy members 68 are enclosed in sleeves on the inner side of the cover 40. The sleeves run about the length 58 of the cover 40. The sleeves are located where the canopy members 68 are positioned along the cover 40 as shown in FIG. 3. The canopy members 68 are preferably inserted into the sleeves after they are assembled. Sleeve 150 is generally located at the intersection 130 between the wall 42C and the roof 44. The second outer canopy member 72B is housed within the sleeve 150. Sleeves are also provided on the inner side of the cover 40 for housing the inner canopy member 70 and the outer canopy members 72A and 72C as well.

Figure 7:
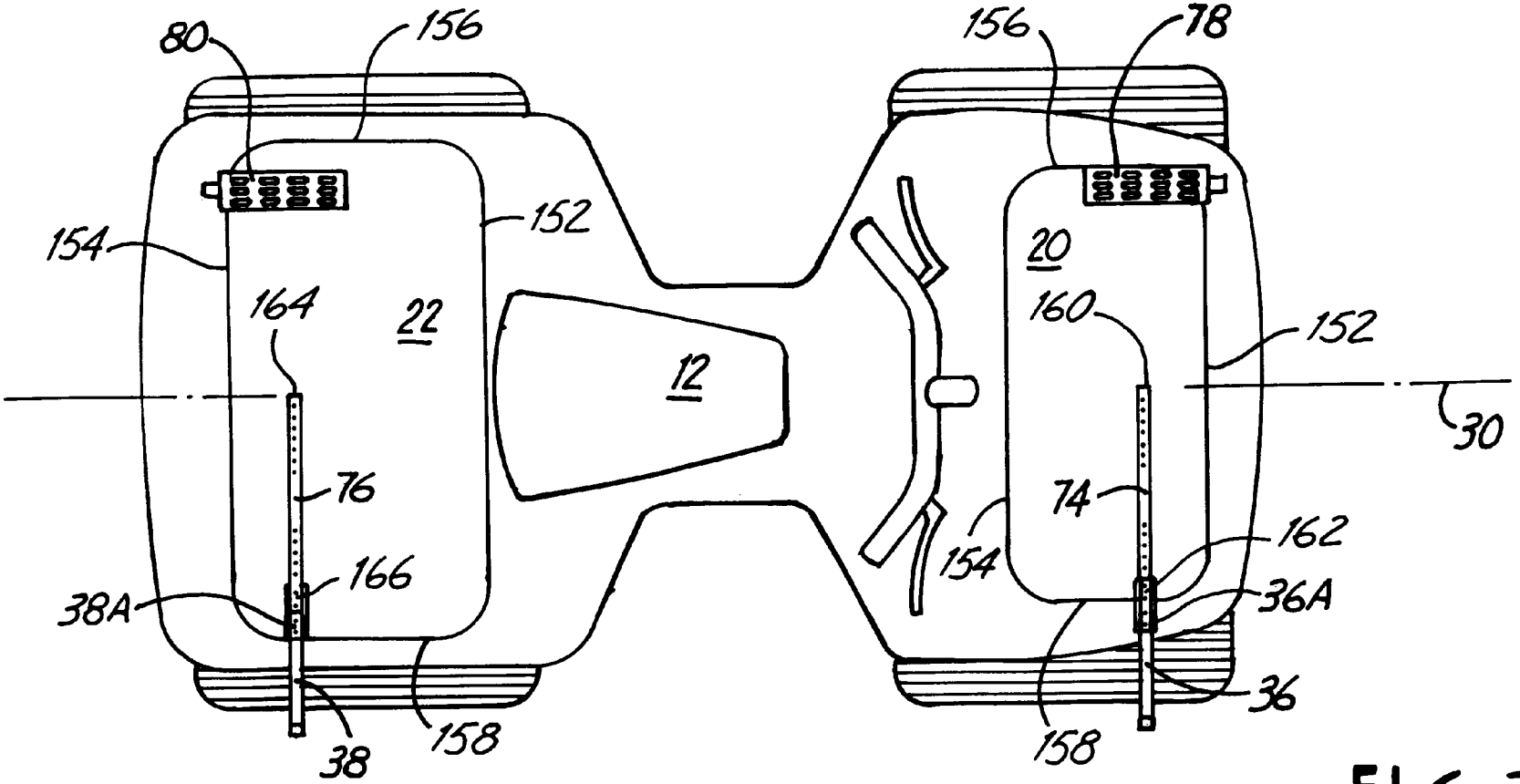
FIG. 7 is a top view of the ATV.

FIG. 7 shows a top view of the ATV 12, and, in particular, how the enclosure is mounted to the front rack 20 and the rear rack 22. The front rack 20 and the rear rack 22 are centered along the longitudinal axis 30 of the ATV 12. Each rack 20 and 22 has a front edge 152, a rear edge 154, a left side edge 156, and a right side edge 158. The front mounting bracket 78 is attached to the front rack 20 such that the front mounting bracket 78 is substantially aligned with the front edge 152 and the left side edge 156 of the front rack 20. The rear mounting bracket 80 is attached to the rear rack 22 of the ATV 12. The rear mounting bracket 80 is substantially aligned with the rear edge 154 and the left side edge 156 of the rear rack 22. The front mounting bracket 78 and the rear mounting bracket 80 are longitudinally aligned to each other. In one embodiment, from end-to-end, the mounting brackets 78 and 80 are approximately 19.25 inches apart. The first canopy bracket 32 (not shown) is attached to the front mounting bracket 78 and the second canopy bracket 34 (not shown) is attached to the second mounting bracket 80.

The arm brackets 74 and 76 are attached to the front and rear racks 20 and 22 of the ATV 12 and are used to mount the arms 36 and 38 to the ATV 12. The arms 36 and 38 are shown in the first position. The front arm bracket 74 has a first end 160 and a second end 162. The front arm bracket 74 is positioned along the right edge 158 of the front rack 20 opposite the front mounting bracket 78. The second end 162 of the front arm bracket 74 is aligned with the right edge 158 of the front rack 20. A first end 36A of the front arm 36 is pivotally mounted to the second end 162 of the front arm bracket 74.

The rear arm bracket 76 having a first end 164 and a second end 166 is attached to the rear rack 22 of the ATV 12. The rear arm bracket 76 is positioned along the right edge 158 of the rear rack 22 opposite the rear mounting bracket 80. The second end 166 is aligned with the right edge 158 of the rear rack 22. A first end 38A of the rear arm 38 is pivotally mounted to the rear end 166 of the second arm bracket 76. The front arm bracket 74 and the rear arm bracket 76 are longitudinally aligned with each other. In one embodiment, the rear ends 36A and 38A of the swing arms 36 and 38 are between about 42 inches and about 47 inches from the mounting brackets 78 and 80.

Figure 8:
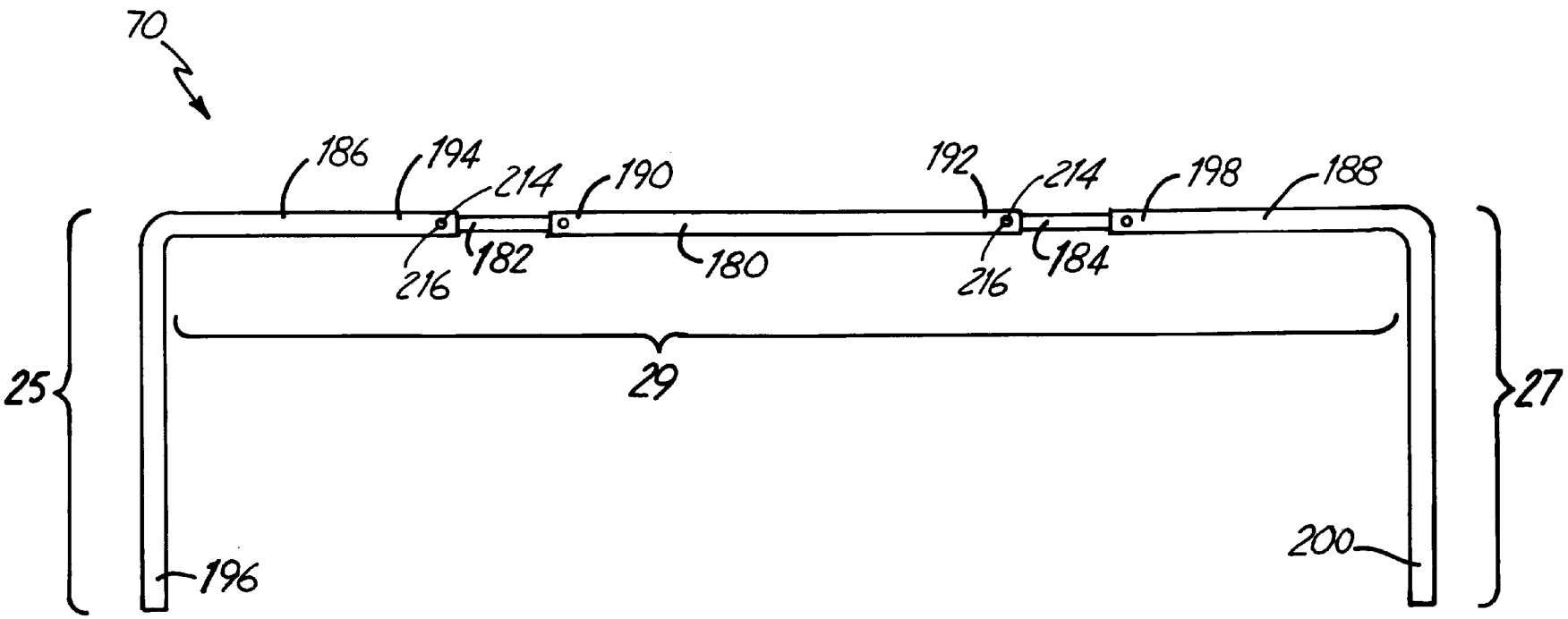
FIG. 8 is a front view of an inner canopy member of the present invention.

FIG. 8 is a front view of the inner canopy member 70. Inner canopy member 70 is formed of a tubular metal. The inner canopy member 70 includes the first section 25, the second section 27 and the connecting member 29. In particular, the inner canopy member 70 is comprised of a support pole 180, a first connector 182, a second connector 184, a first arm 186 and a second arm 188. The support pole 180 has a first end 190 and a second end 192. The first connector 182 is connected to the first end 190 of the support pole 180 and the second connector 184 is connected to the second end 192 of the support pole 180. The support pole 180, the connector 182 and 184, and the first and second arms 186 and 188 are preferably made of steel or aluminum tubing, however those skilled in the art will recognize that other materials may be used for those parts.

The first arm 186 has a first end 194 and a second end 196. The ends 194 and 196 are substantially perpendicular to each other such that the first arm 186 forms a right angle. The first end 194 is connected to the first connector 182. The second end 196 is pivotally mounted to the first canopy bracket 32. The second arm 188 is formed like the first arm 186 to form a right angle. The second arm 188 has a first end 198 which is connected to the second connector 184. A second end 200 of the second arm 188 is pivotally mounted to the second canopy bracket 34. The first and second arms 186 and 188 may form different angles to vary the size and shape of the enclosure 10.

The connectors 182 and 184 are sized slightly smaller than first and second arms 186 and 188 and the support pole 180 thereby allowing the connectors 182 and 184 to slide within the arms 186 and 188 and the support pole 180. The connectors 182 and 184 are preferably locked into position with the support pole 180 and the first and second arms 186 and 188 using a locking pin 214 and a hole 216.

Figure 9:
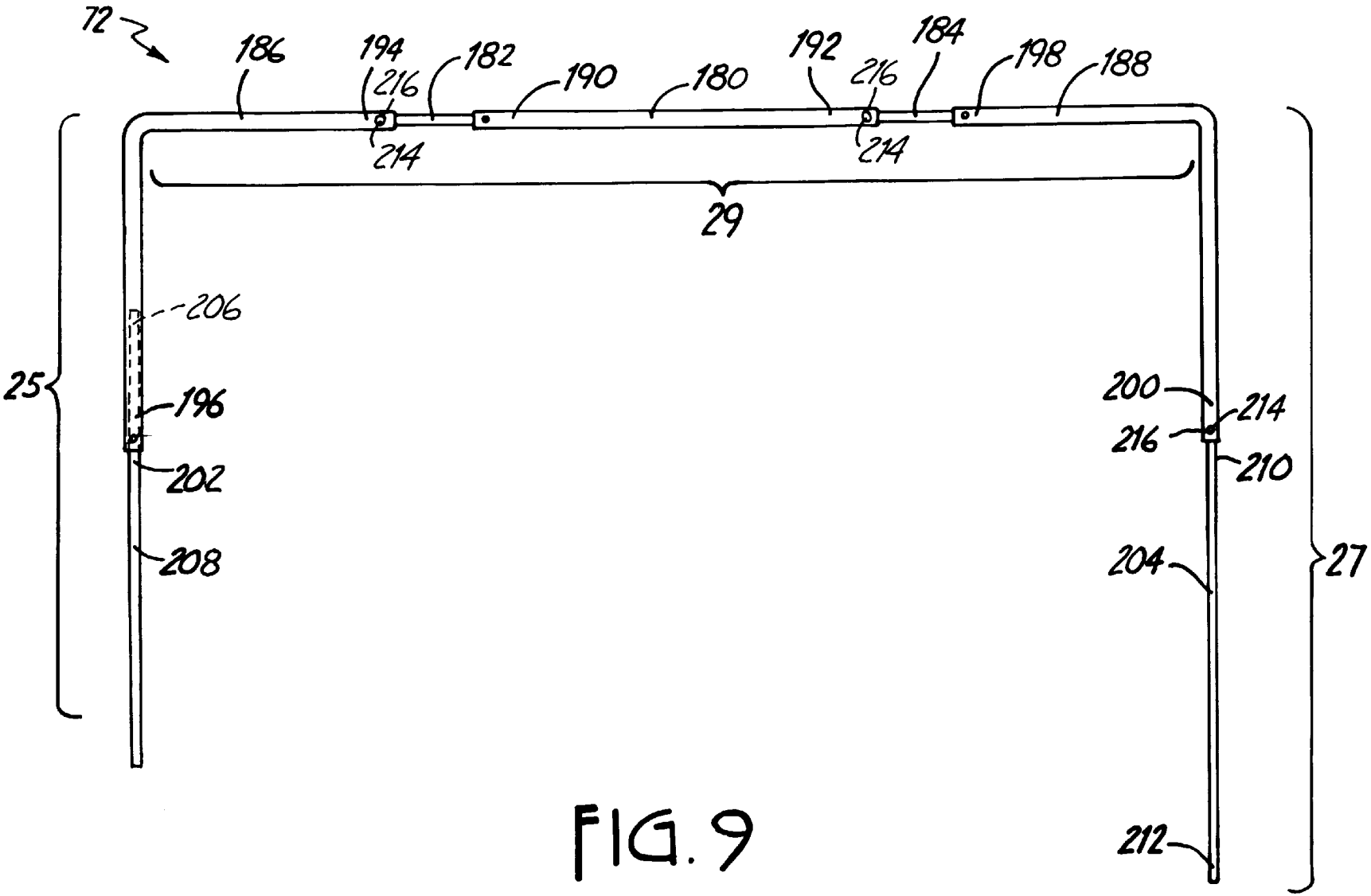
FIG. 9 is a front view of an outer canopy member of the present invention.

FIG. 9 is a front view of one of the outer canopy members 72. Each of the outer canopy members includes the first section 25, the second section 27, and the connecting member 29. in particular, the outer canopy member 72 is comprised of the support pole 180, the first connector 182, the second connector 184, the first arm 186, the second arm 188, a first leg 202, and a second leg 204. In general, the assembly for the outer canopy member is similar to the assembly for the inner canopy member 70. However, canopy members 72 also include telescoping first and second legs 202 and 204, or extensions, which are mounted to the canopy brackets.

The first leg 202 has a first end 206 and a second 208. The first end 206 of the first leg 202 is slidably mounted coaxially within the second end 196 of the first arm 186. The second end 208 of the first leg 202 is pivotally mounted to the canopy bracket 32 (not shown). The second leg 204 has a first end 210 and a second end 212. The first end 210 of the second leg 204 is slidably mounted coaxially within the second end 200 of the second arm 188. The second end 212 of the second leg 204 is pivotally mounted to the second canopy bracket 34 (not shown).

In FIG. 9, the first leg 202 is shown in the collapsed position and the second leg 204 is shown in the open position. In the collapsed position, the legs 202 and 204 lie substantially within first and second arms 186 and 188. In the open position, the legs 202 and 204 extend from the arms 186 and 188 such that sections 25 and 27 of the outer canopy member 72 are lengthened, expanding the size of the enclosure 10. In the open position, a locking pin 214 and a hole 216 are preferably used to lock the legs 202 and 204 extended from the arms 186 and 188. Before moving the enclosure from the open position to the collapsed position, the locking pin 214 is depressed out of the hole 216 to unlock the legs. As the enclosure 10 is moved to the collapsed position, the legs 202 and 204 slide into the arms 186 and 188 thereby decreasing the size of the enclosure 10 for storage.

Although the preferred embodiment of the inventive enclosure 10 is shown with one inner canopy member 70 and three outer canopy members 72, those skilled in the art will recognize that alternate embodiments of the canopy members may be used. For example, fewer or more canopy members may be utilized in the invention. In addition, the canopy members may have other shapes, such as C-shape or V-shape. Also, the canopy members may be made of any number of components, such as a single tubular piece of metal. Furthermore, the inner canopy member may include telescoping legs to extend and lengthen the inner canopy member.

The enclosure 10 has several advantages over prior art shelters for use with ATVs and other vehicles in that the enclosure 10 is portable, easy to open and collapse, and provides a large shelter. The enclosure 10 is assembled once and then mounted to the ATV 12. Once the enclosure 10 is mounted to the ATV 12 in the collapsed position, a user is still able to operate the ATV in a normal fashion. The enclosure can be transported from place to place without disassembly or removal from the ATV 12. Also, attachment and removal of the canopy brackets 32 and 34 allow the enclosure 10 to be easily mounted or dismounted from the ATV 12. The ATV 12 allows a user to transport shelter and equipment to a hunting, ice fishing or camping location more easily.

The enclosure 10 is easily movable from the collapsed position to an open position by the user. The enclosure 10 pivots around the ATV 12 to open or collapse the enclosure. To move the enclosure from the collapsed position to the open position, the user is required to lift upwards on the outer most canopy member and pull such that the canopy members pivot around the canopy brackets and enclose the ATV 12. To move the enclosure 10 from the open position to the collapsed position, the user lifts upward on the outer most canopy member such that the enclosure 10 pivots around the canopy brackets back into the collapsed position.

Once the enclosure 10 is in the open position, the enclosure completely surrounds the ATV 12. The enclosure is large enough provide shelter for both the ATV and the user, for such purposes as hunting, ice fishing or camping. Additionally, during ice fishing the user can fish from within the shelter. The enclosure is wind proof and waterproof to protect the ATV and the user from outside weather conditions.

Although the present invention has been described with reference to preferred embodiments, workers skilled in the art will recognize that changes may be made in form and detail without departing from the spirit and scope of the invention. For example, the enclosure may be adapted for use with other vehicles, such as a snowmobile.

What is claimed is:

1. An enclosure for mounting to an all-terrain vehicle (ATV), the enclosure comprising:

a first bracket mountable to a front rack of the ATV and a second bracket mountable to a rear rack of the ATV;

a frame comprising a plurality of support members pivotally attached to the first and second brackets, wherein the plurality of support members pivot around the brackets between a collapsed position and an open position; and a cover positioned over the frame such that when the frame is in the collapsed position the cover is folded and when the frame is in the open position the cover is open.

2. The enclosure of claim 1 wherein the first and second brackets are reversibly mounted to the ATV.

3. The enclosure of claim 1 wherein the plurality of support members are stacked upon each other when the support members are in the collapsed position.

4. The enclosure of claim 1 wherein the plurality of support members are angularly spaced relative to each other when the support members are in the open position.

5. The enclosure of claim 1 wherein each of the plurality of support members is comprised of tubular metal.

6. The enclosure of claim 1 wherein each of the plurality of support members has opposing arms and a linking section connected between the opposing arms.

7. The enclosure of claim 6 wherein at least one support member comprises arm extensions slidably engaged relative to each of the arms, the arm extensions capable of extending when the at least one support member is in the open position.

8. The enclosure of claim 1 wherein the plurality of support members is comprised of four support members.

9. The enclosure of claim 1 wherein the frame further comprises at least one support pole for reversibly engaging at least one of the support members when the frame is in the open position.

10. The enclosure of claim 1, and further comprising:

a front arm connected to the front rack of the ATV and a rear arm connected to the rear rack of the ATV wherein the front and rear arms pivot between a first position when the frame is in the collapsed position such that the front and rear arms support the collapsed frame and a second position when the frame is in the open position.

11. The enclosure of claim 1 wherein the first and second brackets each comprise:

a mounting section attached to the ATV and a support member holding section reversibly connected to the mounting section.

12. The enclosure of claim 1 wherein the cover is comprised of a wind proof and waterproof material.

13. The enclosure of claim 1 wherein the cover comprises four walls and a roof.

14. The enclosure of claim 13 wherein a plurality of windows are formed in the walls of the cover.

15. The enclosure of claim 13 wherein a portion of the roof is removable.

16. The enclosure of claim 1 wherein the enclosure is sized to completely cover the ATV when the frame is in the open position.

17. The enclosure of claim 16 wherein the enclosure has a width greater than a width of the ATV.

* * * * *